US012631339B2

(12) United States Patent
Lee et al.

(10) Patent No.: US 12,631,339 B2
(45) **Date of Patent: *May 19, 2026**

(54) ELECTRIC RANGE

(71) Applicant: LG ELECTRONICS INC., Seoul (KR)

(72) Inventors: Jaeho Lee, Seoul (KR); Il Young Park, Seoul (KR); Seunghak Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 26 days.

This patent is subject to a terminal disclaimer.

(21) Appl. No.: 18/372,213

(22) Filed: Sep. 25, 2023

(65) Prior Publication Data

US 2024/0011640 A1 Jan. 11, 2024

Related U.S. Application Data

(62) Division of application No. 17/199,846, filed on Mar. 12, 2021, now Pat. No. 11,802,694.

(30) Foreign Application Priority Data

Mar. 12, 2020 (KR) ..... 10-2020-0030996

(51) Int. Cl.
*F24C 7/06* (2006.01)
*F24C 15/10* (2006.01)

(52) U.S. Cl.
CPC ..... *F24C 7/067* (2013.01); *F24C 15/101* (2013.01); *F24C 15/102* (2013.01)

(58) Field of Classification Search
CPC ..... F24C 15/102; F24C 15/101; F24C 7/067; H05B 6/1209; A45F 5/021
USPC ..... 219/452.12
See application file for complete search history.

(56) References Cited

U.S. PATENT DOCUMENTS 4,029,926 A 6/1977 Austin
5,038,985 A * 8/1991 Chapin ..... G01B 5/0002 24/3.12
2008/0142512 A1 6/2008 Kim et al.
2010/0044367 A1 2/2010 Kim et al.
2010/0187222 A1 7/2010 Kim et al.
2012/0223070 A1 9/2012 Matsui et al.
(Continued)

FOREIGN PATENT DOCUMENTS

DE 20 2009 000991 4/2009
DE 102010028549 * 11/2010
(Continued)

OTHER PUBLICATIONS

DE102010028549 (Year: 2024).*
(Continued)

*Primary Examiner* — Steven W Crabb
*Assistant Examiner* — Spencer H. Kirkwood
(74) *Attorney, Agent, or Firm* — KED & ASSOCIATES

(57) ABSTRACT

An electric range is provided in which a lower surface of a base plate, on an upper end of which a working coil is placed, may be supported by at least one elastic supporter disposed at an upper end of at least one air guide along a widthwise direction of the base plate, thereby preventing bending of the base plate and maintaining a constant gap between an object to be heated and the working coil.

17 Claims, 13 Drawing Sheets

(56) References Cited

U.S. PATENT DOCUMENTS

| | | | | |
|---|---|---|---|---|
| 2016/0295644 | A1 | 10/2016 | Khokle et al. | |
| 2019/0234616 | A1 | 8/2019 | Yang | |
| 2019/0281667 | A1 | 9/2019 | Khokle et al. | |
| 2019/0297681 | A1 | 9/2019 | Parachini | |
| 2020/0138189 | A1* | 5/2020 | Canova | A47B 81/005 |
| 2021/0267021 | A1* | 8/2021 | Jeanneteau | H05B 6/1263 |
| 2022/0355465 | A1* | 11/2022 | Koda | B25J 5/00 |

FOREIGN PATENT DOCUMENTS

| | | | | |
|---|---|---|---|---|
| DE | 102010028549 | A1 * | 11/2010 | H05B 6/1209 |
| EP | 1 936 283 | | 6/2008 | |
| EP | 2 473 001 | | 7/2012 | |
| KR | 10-2014-0124106 | | 10/2014 | |
| KR | 10-2014-0131118 | | 11/2014 | |
| KR | 10-2018-0025755 | | 3/2018 | |
| WO | WO 2008/103009 | | 8/2008 | |
| WO | WO 2008/155922 | | 12/2008 | |
| WO | WO-2011077332 | A1 * | 6/2011 | F24C 15/102 |

OTHER PUBLICATIONS

European Search Report issued in Application No. 21162104.0 dated Aug. 24, 2021.
Translation EP 3879927 (Year: 2022).
Translation EP 2498574 (Year: 2022).
Translation EP 4009743 (Year: 2022).
Translation EP 3334248 (Year: 2022).
Translation EP 3651550 (Year: 2022).
Translation ES2039188 (Year: 2022).
Translation KR1020180025755 (Year: 2022).
Translation WO20122062881 (Year: 2022).
Translation EP 3599793 (Year: 2022).
Translation DE102010028549 (Year: 2022).
Translation EP1936283 (Year: 2022).
Translation EP2473001 (Year: 2022).
Translation EP3879929 (Year: 2022).
U.S. Office Action dated Nov. 21, 2022 issued in U.S. Appl. No. 17/199,846.

* cited by examiner

ELECTRIC RANGE

CROSS-REFERENCE TO RELATED APPLICATION(S)

This application is a Divisional of U.S. patent application Ser. No. 17/199,846, filed Mar. 12, 2021, which claims priority under 35 U.S.C. § 119 to Korean Application No. 10-2020-0030996, filed in Korea on Mar. 12, 2020, whose entire disclosure(s) is/are hereby incorporated by reference.

BACKGROUND

1. Field

An electric range is disclosed herein.

2. Background

Various types of cooking appliances are used to heat food or other items (hereinafter, collectively "food") at homes or restaurants. The cooking appliances include gas ranges using gas and electric ranges using electricity.

The electric ranges are classified as resistance heating-type electric ranges and induction heating-type electric ranges. In a resistance heating method, electric current is supplied to a metallic resistance wire or a non-metallic heat generation element, such as silicon carbide to generate heat, and the generated heat is radiated or conducted to heat an object to be heated, for example, a cooking vessel, such as a pot, or a frying pan, for example. In an induction heating method, high-frequency power is supplied to a coil to generate a magnetic field around the coil, and eddy current produced in the generated magnetic field is used to heat an object to be heated made of a metallic material.

When electric current is supplied to a working coil or a heating coil, heat is generated while an object to be heated is inductively heated. The object to be heated is heated by the generated heat.

A working coil of an electric range of the related art, configured as described above, is disposed at an upper end of a base plate made of aluminum. The base plate is disposed at an upper end of a case forming a space in which a substrate and electronic components are disposed.

The working coil is made of a metallic material and has a predetermined weight. In the related art, elastic rods elastically supporting edges of the base plate are disposed in the case to support the base plate. When the working coil is disposed at an upper end of a center of the base plate, the center of the base plate bends downward. Additionally, when each of the elastic rods has a different elastic force, the base plate tilts to one side without ensuring a balance. Thus, in the related art, a constant gap between an object to be heated, mounted onto a cover disposed on the base plate, and a working coil cannot be ensured.

BRIEF DESCRIPTION OF THE DRAWINGS

Embodiments will be described in detail with reference to the following drawings in which like reference numerals refer to like elements, and wherein.

DETAILED DESCRIPTION

Figure 1:
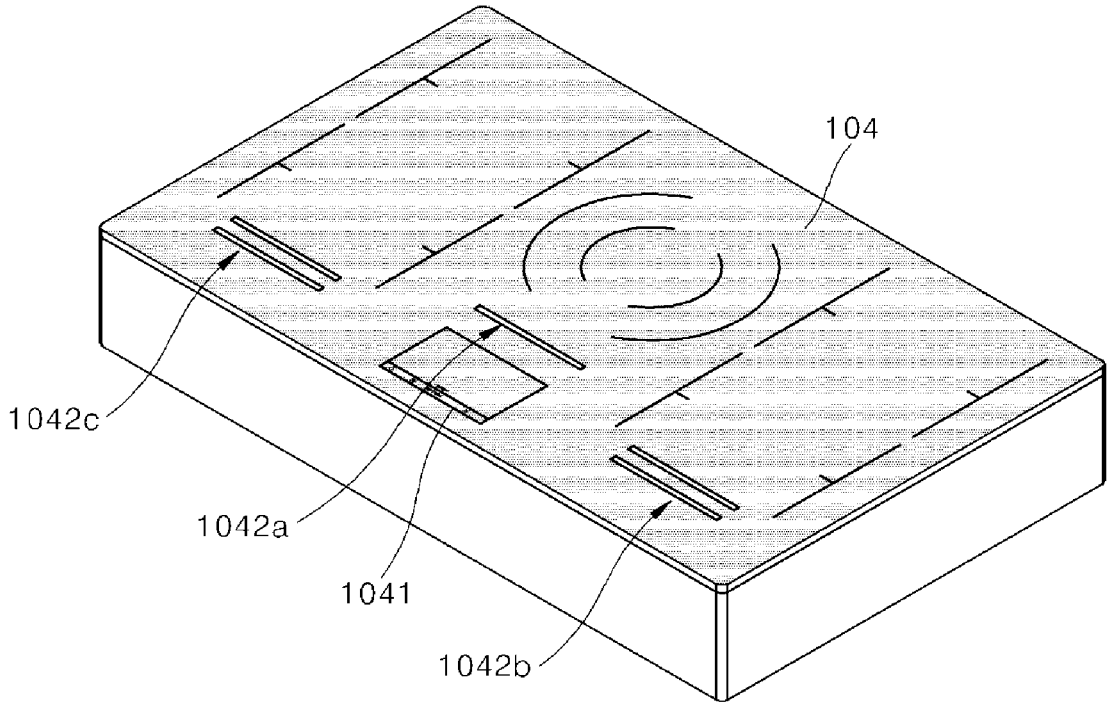
FIG. 1 is a perspective view of an electric range according to an embodiment.

Embodiments are described hereinafter with reference to the accompanying drawings such that one having ordinary skill in the art to which the embodiments pertain may easily implement the technical idea. In the disclosure, description of known technologies in relation to the disclosure is omitted if it is deemed to make the gist unnecessarily vague. In the drawings, the same or like reference numerals denote the same or like components.

The terms "first", "second" and the like are used herein only to distinguish one component from another component. Thus, the components should not be limited by the terms. Certainly, a first component can be a second component unless stated to the contrary.

When one component is described as being "in an upper portion (or a lower portion)" of another component, or "on (or under)" another component, one component can be placed on the upper surface (or under the lower surface) of another component, and an additional component may be interposed between another component and one component on (or under) another component.

When one component is described as being "connected", "coupled", or "connected" to another component, one component can be directly connected, coupled or connected to another component; however, it is also to be understood that an additional component can be "interposed" between the two components, or the two components can be "connected", "coupled", or "connected" through an additional component.

Hereinafter, each component may be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "have," set forth herein, are not interpreted as necessarily including all the stated components or steps but can be interpreted as including some of the stated components or steps or can be interpreted as further including additional components or steps.

Hereinafter, the terms "A and/or B" as used herein can denote A, B or A and B, and the terms "C to D" can denote C or greater and D or less, unless stated to the contrary.

Hereinafter, an electric range is described with reference to several embodiments. The electric range disclosed herein may include an electric resistance-type electric range and an induction heating-type electric range, for example, an induction heating device. For convenience, an induction heating device, provided with a working coil as a heating unit, is described as an example during description of the embodiments. However, embodiments are not limited to those set forth herein.

FIG. 1 is a perspective view of an electric range 100 according to an embodiment. FIGS. 2 to 5 are perspective views of the electric range 100 in FIG. 1 without some components.

Figure 2:
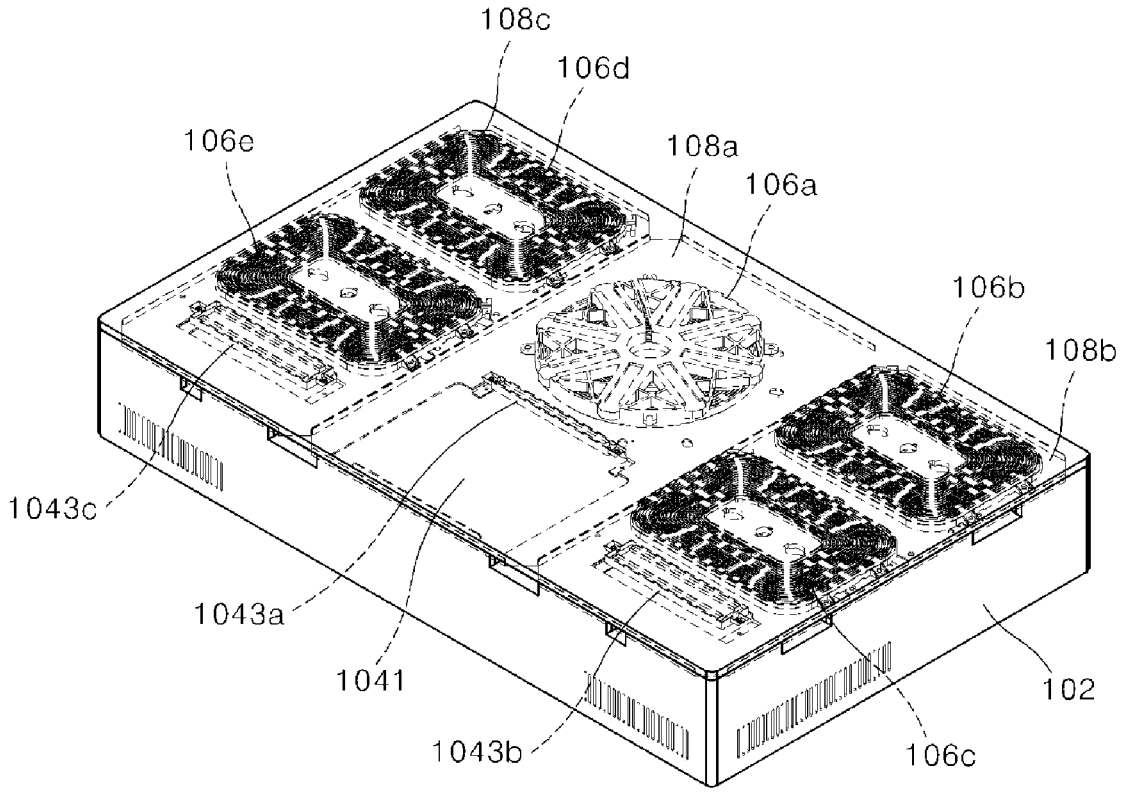
FIGS. 2 to 5 are perspective views of the electric range in FIG. 1 without some components.
Figure 3:
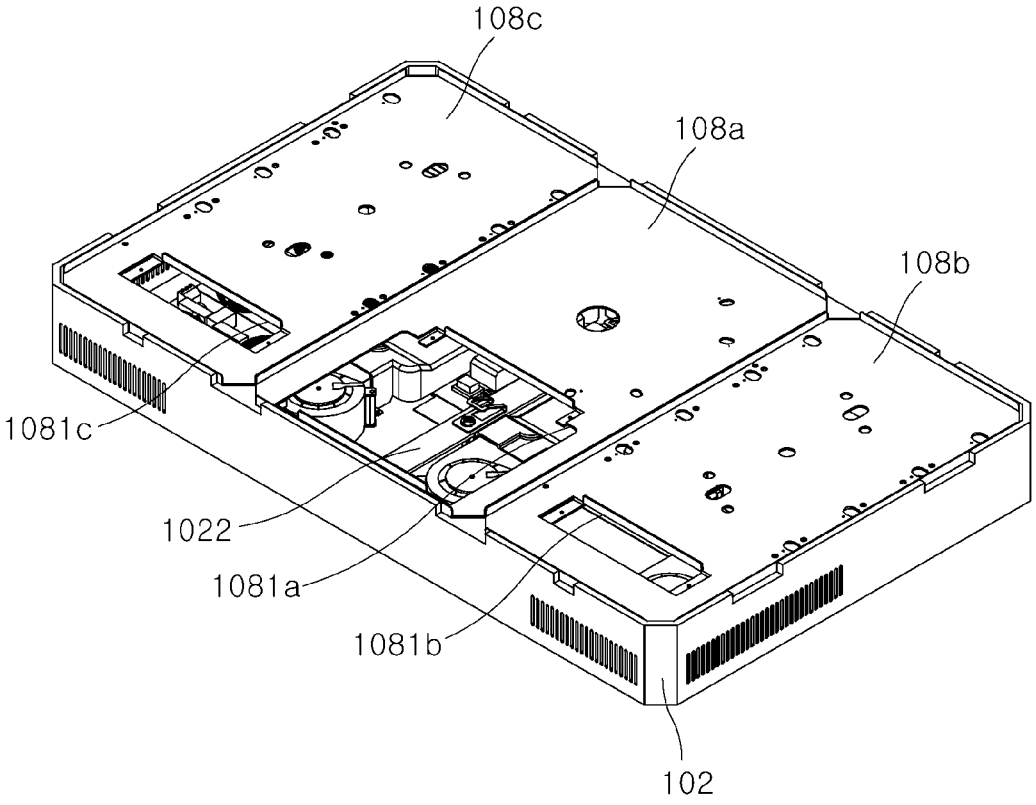
Figure 4:
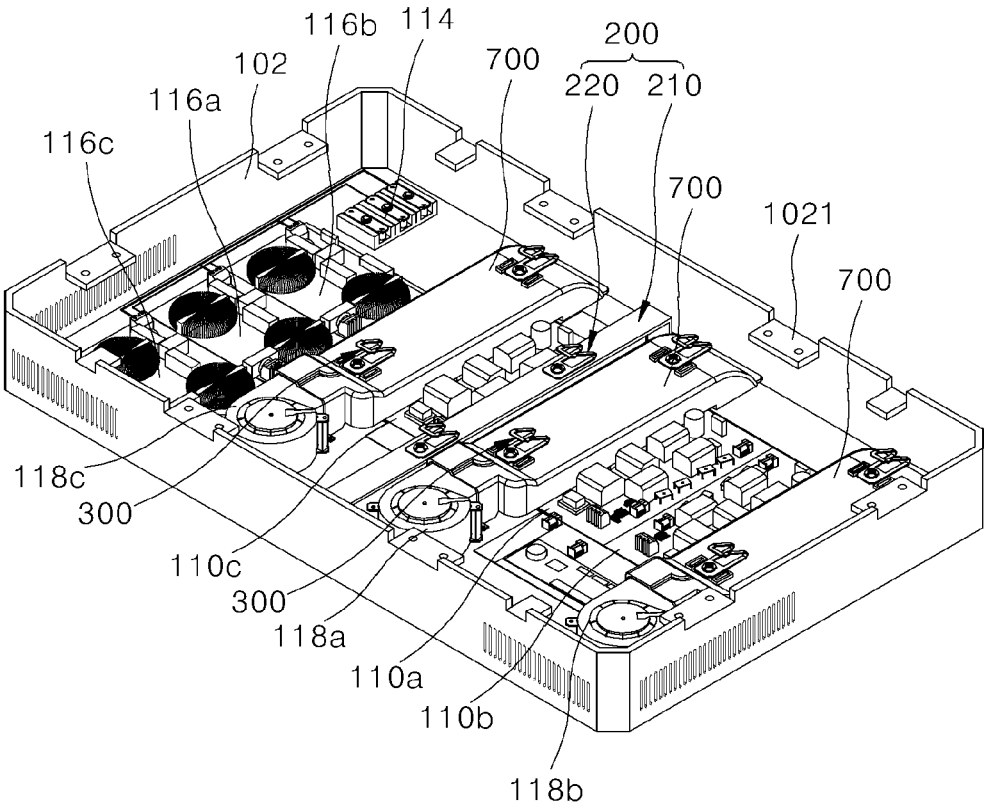
Figure 5:
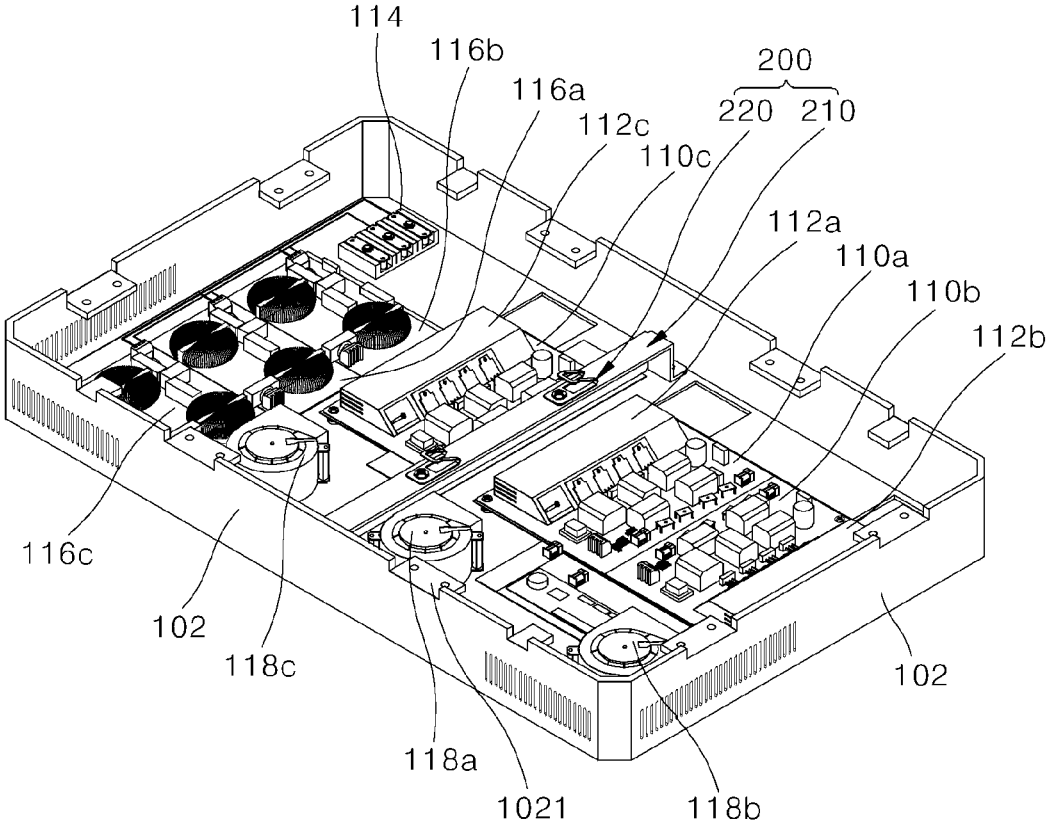

More specifically, FIG. 2 is a view showing the electric range 100 in FIG. 1 without cover plate 104, FIG. 3 is a view showing the electric range 100 in FIG. 1 without cover plate 104 and one or more working coil 106*a*, 106*b*, 106*c*, 106*d*, 106*e*, FIG. 4 is a view showing the electric range 100 in FIG. 1 without cover plate 104, one or more working coil 106*a*, 106*b*, 106*c*, 106*d*, 106*e*, and one or more base plate 108*a*, 108*b*, 108*c*, and FIG. 5 is a view showing the electric range 100 in FIG. 1 without cover plate 104, one or more working coil 106*a*, 106*b*, 106*c*, 106*d*, 106*e*, one or more base plate 108*a*, 108*b*, 108*c*, and one or more air guide 700.

Referring to FIGS. 1 to 5, the electric range 100 according to an embodiment may include a case 102, the cover plate 104, one or more working coil 106*a*, 106*b*, 106*c*, 106*d*, 106*e*, one or more base plate 108*a*, 108*b*, 108*c*, one or more drive circuit 110*a*, 110*b*, 110*c*, one or more heat sink 112*a*, 112*b*, 112*c*, a power feeder 114, one or more filter circuit 116*a*, 116*b*, 116*c*, one or more air blowing fan 118*a*, 118*b*, 118*c*, and one or more air guide 700. The case 102 may protect and/or accommodate components in the electric range 100. For example, the case 102 may be made of aluminum or any other metal; however, embodiments are not limited thereto. The case 102 may be thermally insulated to prevent heat, generated by the one or more working coil 106*a*, 106*b*, 106*c*, 106*d*, 106*e*, from leaking outward. The case 102 is formed to have a predetermined height. The case 102 has two short side portions and two long side portion being connected or integrally formed to form a frame which surrounds the inner space. The case 102 is open at its upper portion and may be closed at the bottom surface 102*b* with a bottom plate.

The cover plate 104 may be coupled to an upper end of the case 102 to shield an inside of the case 102, and an object to be heated (not illustrated, an object to be heated by the one or more working coil 106*a*, 106*b*, 106*c*, 106*d*, 106*e*) may be placed on an upper surface of the cover plate 104.

An object to be heated, such as a cooking vessel, may be placed on the upper surface of the cover plate 104, and heat generated by the at least one working coil 106*a*, 106*b*, 106*c*, 106*d*, 106*e* may be delivered to the object to be heated through the upper surface of the cover plate 104. The cover plate 104 may be made of glass; however, embodiments are not limited thereto.

An input interface 1041 configured to receive an input from a user may be disposed on the upper surface of the cover plate 104. The input interface 1041 may be recessed into the upper surface of the cover plate 104 in a flat manner and may display a specific image. The input interface 1041 may receive a touch input from the user, and the electric range 100 may be driven based on the received touch input.

More specifically, the input interface 1041 may be a module for controlling the operation of the electric range, in particular by inputting a heating intensity or a heating period, for example, desired by the user, and may be implemented as a physical button or a touch panel, for example. Additionally, the input interface 1041 may display a drive state of the electric range 100. For example, the input interface 1041 may be a liquid crystal display (TFT LCD), LED or OLED; however, embodiments are not limited thereto.

One or more light display area 1042*a*, 1042*b*, 1042*c* may be formed on the upper surface of the cover plate 104. One or more light source unit (lighting unit) 1043*a*, 1043*b*, 1043*c* may be disposed below/under the cover plate 104, and light emitted from the one or more light source unit 1043*a*, 1043*b*, 1043*c* may be delivered to the user through the one or more light display area 1042*a*, 1042*b*, 1042*c*.

The working coil 106*a*, 106*b*, 106*c*, 106*d*, 106*e* may be a heating unit that heats an object to the heated, and may be disposed in the case 102. The working coil 106*a*, 106*b*, 106*c*, 106*d*, 106*e* may include a wire wound multiple times in a ring shape, and may generate an alternating current (AC) magnetic field. Additionally, a mica sheet and a ferrite core may be consecutively disposed on a lower side of the working coil 106*a*, 106*b*, 106*c*, 106*d*, 106*e*.

The ferrite core may be fixed to the mica sheet through a sealant, and may diffuse the AC magnetic field generated by the working coil 106*a*, 106*b*, 106*c*, 106*d*, 106*e*. The mica sheet may be fixed to the working coil 106*a*, 106*b*, 106*c*, 106*d*, 106*e* and the ferrite core through the sealant, and may prevent direct delivery of the heat, generated by the working coil 106*a*, 106*b*, 106*c*, 106*d*, 106*e*, to the ferrite core.

A plurality of working coils 106*a*, 106*b*, 106*c*, 106*d*, 106*e* may be provided. The plurality of working coils 106*a*, 106*b*, 106*c*, 106*d*, 106*e* may include first working coil 106*a* disposed at a central portion of the case 102, second working coil 106*b* and third working coil 106*c* disposed on a right (first) side of the first working coil 106*a*, and a fourth working coil 106*d* and a fifth working coil 106*e* disposed on a left (second) side of the first working coil 106*a*. The second working coil 106*b* and the third working coil 106*c* may be disposed on the right side of the first working coil 106*a* in a frontward-rearward direction, and the fourth working coil 106*d* and the fifth working coil 106*e* may be disposed on the left side of the first working coil 106*a* in the frontward-rearward direction.

For example, the first working coil 106*a* may be a high-output dual heating coil, and at least one of the second working coil 106*b*, the third working coil 106*c*, the fourth working coil 106*d* and/or the fifth working coil 106*e* may be a single heating coil and/or having a lower output than the first coil.

The electric range 100 according to an embodiment may perform the function of wireless power transmission based on configurations and features described above.

Technologies for wirelessly supplying power have been developed and have been used for a wide range of electronic devices. A battery of an electronic device, to which the wireless power transmitting technology is applied, can be charged only by being placed on a charge pad without connecting to an additional charge connector. Accordingly, the electronic device, to which the wireless power transmitting technology is applied, requires no cord or no charger, thereby ensuring improved mobility and a reduced size and weight.

The wireless power transmitting technology can be broadly classified as an electromagnetic induction technology using a coil, a resonance technology using resonance, and a radio emission technology for converting electric energy into microwaves and delivering the microwaves, for example. In the electromagnetic induction technology, power is transmitted using electromagnetic induction between a primary coil, that is, a working coil, included in an apparatus for wirelessly transmitting power and a secondary coil included in an apparatus for wirelessly receiving power.

The theory of the induction heating technology of the electric range 100 is substantially the same as that of the electromagnetic induction-based wireless power transmission technology, in that an object to be heated is heated using electromagnetic induction. Accordingly, the electric range 100 according to an embodiment may perform the function of wireless power transmission as well as the function of induction heating.

The one or more base plate 108*a*, 108*b*, 108*c* may be disposed at a middle of the case 102, and the plurality of working coils 106*a*, 106*b*, 106*c*, 106*d*, 106*e* may be disposed on the one or more base plates 108*a*, 108*b*, 108*c*. So the one or more base plates may separate the inner space of the case into a lower portion and an upper portion. The upper portion is for accommodating the working coils. The lower portions is provided for accommodating the electronic components. The one or more base plate 108*a*, 108*b*, 108*c* may support the plurality of working coils 106*a*, 106*b*, 106*c*, 106*d*, 106*e*, which are heavy, and may help the plurality of working coils 106*a*, 106*b*, 106*c*, 106*d*, 106*e* to be mounted. The input interface 1041 and the one or more light source unit 1043*a*, 1043*b*, 1043*c* may be further disposed at the upper portion of the one or more base plate 108*a*, 108*b*, 108*c*.

According to one embodiment, a plurality of base plates 108*a*, 108*b*, 108*c* may be provided; however, embodiments are not limited thereto. Alternatively, a single base plate may be disposed in the case 102.

The plurality of base plates 108*a*, 108*b*, 108*c* may include first base plate 108*a*, second base plate 108*b*, and third base plate 108*c*. The first base plate 108*a*, the second base plate 108*b*, and the third base plate 108*c* may be disposed at the middle of the case 102 side by side.

The first base plate 108*a* may be disposed at a central portion of the middle of the case 102. The first working coil 106*a* may be disposed on the first base plate 108*a*. Middle end means a position lower than the upper edge of the case and higher as the bottom surface of the case.

The input interface 1041, and first light source unit 1043*a* corresponding to the first working coil 106*a* may be disposed on the first base plate 108*a*. On/In the upper portion of the first base plate 108*a*, the input interface 1041 may be disposed on a lower side of the first light source unit 1043*a*, and the first light source unit 1043*a* may be disposed on a lower side of the input interface 1041. The first base plate 108*a* may have a through hole 1081*a* for installing the input interface 1041 and the first light source unit 1043*a*.

The second base plate 108*b* may be disposed on a right (first) side of the first base plate 108*a* at the middle of the case 102. The second working coil 106*b* and the third working coil 106*c* may be disposed on/in an upper portion of the second base plate 108*b*.

A second light source unit 1043*b* corresponding to the second working coil 106*b* and the third working coil 106*c* may be further disposed on/in the upper portion of the second base plate 108*b*. On/In the upper portion of the second base plate 108*b*, the second working coil 106*b*, the third working coil 106*c*, and the second light source unit 1043*b* may be consecutively disposed. The second base plate 108*b* may have a through hole 1081*b* for installing the second light source unit 1043*b*.

The third base plate 108*c* may be disposed on a left (second) side of the first base plate 108*a* at the middle of the case 102. The fourth working coil 106*d* and the fifth working coil 106*e* may be disposed on/in an upper portion of the third base plate 108*c*.

At least one of the first, second and third base plate might have an inclined corner or cut corner, to thereby facilitate the assembling of the base plates on the mounting portions extending inside the case, where the edges of the first, second and third base plate are supported or rest on.

A third light source unit 1043*c* corresponding to the fourth working coil 106*d* and the fifth working coil 106*e* may be further disposed on/in the upper portion of the third base plate 108*c*. On/In the upper portion of the third base plate 108*c*, the fourth working coil 106*d*, the fifth working coil 106*e*, and the third light source unit 1043*c* may be consecutively disposed. The third base plate 108*c* may have a through hole 1081*c* for installing the third light source unit 1043*c*.

The case 102 may have a plurality of mounting portions 1021 for mounting the plurality of base plates 108*a*, 108*b*, 108*c* in portions of an outer circumferential surface of the case 102. The mounting portions are bent inside the inner space to provide a support surface for the base plates. That is, edges of the plurality of base plates 108*a*, 108*b*, 108*c* may be mounted onto tops of the plurality of mounting portions 1021. Accordingly, the plurality of base plates 108*a*, 108*b*, 108*c* may be disposed at the middle end of the case 102.

The second base plate 108*b* and the third base plate 108*c* may be disposed on both sides of the first base plate 108*a*.

The first base plate 108*a* may be disposed between the second base plate 108*b* and the third base plate 108*c*.

Portions of lower surfaces of three outer edges or circumferences of each of the second base plate 108*b* and the third base plate 108*c* may be supported by the mounting portions 1021 disposed on the outer circumferential surface of the case 102.

A supported portion of the first base plate 108*a* between the second base plate 108*b* and the third base plate 108*c* may be smaller than the supported portions of the second and third base plates 108*b*, 108*c*. This is in particular true, as the first base plate is only supported at the one or more mounting portions 1021 at the long side walls of the case, e.g. the lower and upper side of the case. This is different for the second and third base plates 108*b*, and 108*c*, which are supported additionally by mounting portions 1021 extending from the short side wall of the case. Thus, these base plates 108*b*, 108*c* are supported at three side edges. The first base plate being arranged in the middle is only supported at two opposing side edges.

Thus, a center of the first base plate 108*a* may sag.

Therefore, it is advantageously if the air guide 700 may be disposed under/in a lower portion of the first base plate 108*a* and if an elastic supporter 300 may be disposed at an upper end of the air guide 700. Thus, the elastic supporter 300 may support a lower portion of the first base plate 108*a* between the second base plate 108*b* and the third base plate 108*c*. Thus, the center of the first base plate 108*a* may be prevented from sagging. A bracket 210 may be disposed at a central portion of a lower end of the case 102. The bracket 210 may be disposed at a central portion of a lower side of the first base plate 108*a*, and may prevent bending, that is, sagging of the first base plate 108*a*, caused by a weight of the first base plate 108*a*. The weight of the first base plate 108*a* may include a weight of the first working coil 106*a* on/in the upper portion of the first base plate 108*a*.

At least one elastic member 220 may be disposed on the bracket 210. For example, the elastic member 220 may be a leaf spring. An upper end of at least one elastic member 220 may contact a lower surface of the first base plate 108*a*, and may prevent sagging of the first base plate 108*a*. A configuration and mechanism for preventing bending are described hereinafter.

The one or more drive circuit 110*a*, 110*b*, 110*c* may control driving of the plurality of working coils 106*a*, 106*b*, 106*c*, 106*d*, 106*e*, which are heating units, and may further control driving of components, such as the input interface 1041, for example, of the electric range 100.

The one or more drive circuit 110*a*, 110*b*, 110*c* may include various components in relation to the driving of the working coils 106*a*, 106*b*, 106*c*, 106*d*, 106*e*. The components may include a power supply configured to supply AC power, a rectifier configured to rectify AC power of the power supply into direct current (DC) power, an inverter configured to convert DC power, rectified by the rectifier, into resonance current as a result of a switching operation and supply the resonance current to the working coil 106, a microcomputer, for example, a micom configured to control the inverter and components in relation to driving of the inverter, and a relay or a semiconductor switch configured to turn on or turn off the working coils 106*a*, 106*b*, 106*c*, 106*d*, 106*e*, for example.

The one or more drive circuit 110*a*, 110*b*, 110*c* may include first drive circuit 110*a*, second drive circuit 110*b*, and third drive circuit 110*c*. The first drive circuit 110*a* may be disposed on a right (first) side of the lower end of the case 102 with respect to the bracket 210 and may control driving of the first working coil 106*a*. The second drive circuit 110*b* may be disposed on a right (first) side of the first drive circuit 110*a* and may control driving of the second working coil 106*b* and the third working coil 106*c*. The third drive circuit 110*c* may be disposed on a left (second) side of the lower end of the case 102 with respect to the bracket 210 and may control driving of the fourth working coil 106*d* and the fifth working coil 106*e*.

The one or more heat sink 112*a*, 112*b*, 112*c* may be disposed over a portion of the drive circuit 110*a*, 110*b*, 110*c* and may prevent an increase in temperature of components disposed in or at a portion of the drive circuits 110*a*, 110*b*, 110*c*. The heat sink 112*a*, 112*b*, 112*c* may include first heat sink 112*a*, second heat sink 112*b*, and third heat sink 112*c*. The first heat sink 112*a* may prevent an increase in temperature of components installed in a portion of the first drive circuit 110*a*, the second heat sink 112*b* may prevent an increase in temperature of components installed in a portion of the second drive circuit 110*b*, and the third heat sink 112*c* may prevent an increase in temperature of components installed in a portion of the third drive circuit 110*c*.

The power feeder 114 may supply power from an external power source to the electric range 100. The power feeder 114 may be implemented as a terminal block, for example.

The power feeder 114 may be disposed at any one of edges of the lower end of the case 102. For example, the power feeder 114 may be disposed at an upper end of the left side of the lower end of the case 102.

The one or more filter circuit 116*a*, 116*b*, 116*c* may be disposed at any one of the edges of the lower end of the case 102, and may reduce noise made by the plurality of working coils 106*a*, 106*b*, 106*c*, 106*d*, 106*e*. The one or more filter circuit 116*a*, 116*b*, 116*c* may include first filter circuit 116*a*, second filter circuit 116*b*, and third filter circuit 116*c*.

The first filter circuit 116*a* may reduce noise made by the first working coil 106*a*. The second filter circuit 116*b* may reduce noise made by the second working coil 106*b* and the third working coil 106*c*. The third filter circuit 116*c* may reduce noise made by the fourth working coil 106*d* and the fifth working coil 106*e*.

The one or more air blowing fan 118*a*, 118*b*, 118*c* may reduce a temperature inside of the case 102. Accordingly, the one or more air blowing fan 118*a*, 118*b*, 118*c* may lower a temperature of various components installed in or on the drive circuits 110*a*, 110*b*, 110*c*.

The one or more air blowing fan 118*a*, 118*b*, 118*c* may include first air blowing fan 118*a*, second air blowing fan 118*b*, and third air blowing fan 118*c*. The first air blowing fan 118*a* may cool various components installed in or on the first drive circuit 110*a* and may further cool the light source unit 1043 corresponding to the first working coil 106*a*. In particular, the first air blowing fan 118*a* may deliver air (wind) for cooling to the first heat sink 112*a* over the first drive circuit 110*a*.

The second air blowing fan 118*b* may cool various components installed in or on the second drive circuit 110*b* and may further cool the light source unit 1043 corresponding to the second working coil 106*b* and the third working coil 106*c*. In particular, the second air blowing fan 118*b* may deliver air for cooling to the second heat sink 112*b* over the second drive circuit 110*b*.

The third air blowing fan 118*c* may cool various components installed in or on the third drive circuit 110*c* and may further cool the light source unit 1043 corresponding to the fourth working coil 106*d* and the fifth working coil 106*e*. In particular, the third air blowing fan 118*c* may deliver air for cooling to the third heat sink 112*c* over the third drive circuit 110*c*.

The air blowing fans 118*a*, 118*b*, 118*c* may not be provided with a structure for preventing foreign substances from contacting the air blowing fans 118*a*, 118*b*, 118*c*. The air guide 700 may guide air (wind) generated by the air blowing fan 118*a*, 118*b*, 118*c*.

The air guide 700 may include first air guide 700, second air guide 700 and third air guide 700. The first air guide 700 may encircle the first heat sink 112*a* installed over a portion of the first drive circuit 110*a* and may guide (deliver) air, output from the first air blowing fan 118*a*, to the first heat sink 112*a*. The second air guide 700 may encircle the second heat sink 112*b* installed over a portion of the second drive circuit 110*b* and may guide air, output from the second air blowing fan 118*b*, to the second heat sink 112*b*. The third air guide 700 may encircle the third heat sink 112*c* installed over a portion of the third drive circuit 110*c* and may guide air, output from the third air blowing fan 118*c*, to the third heat sink 112*c*.

Figure 6:
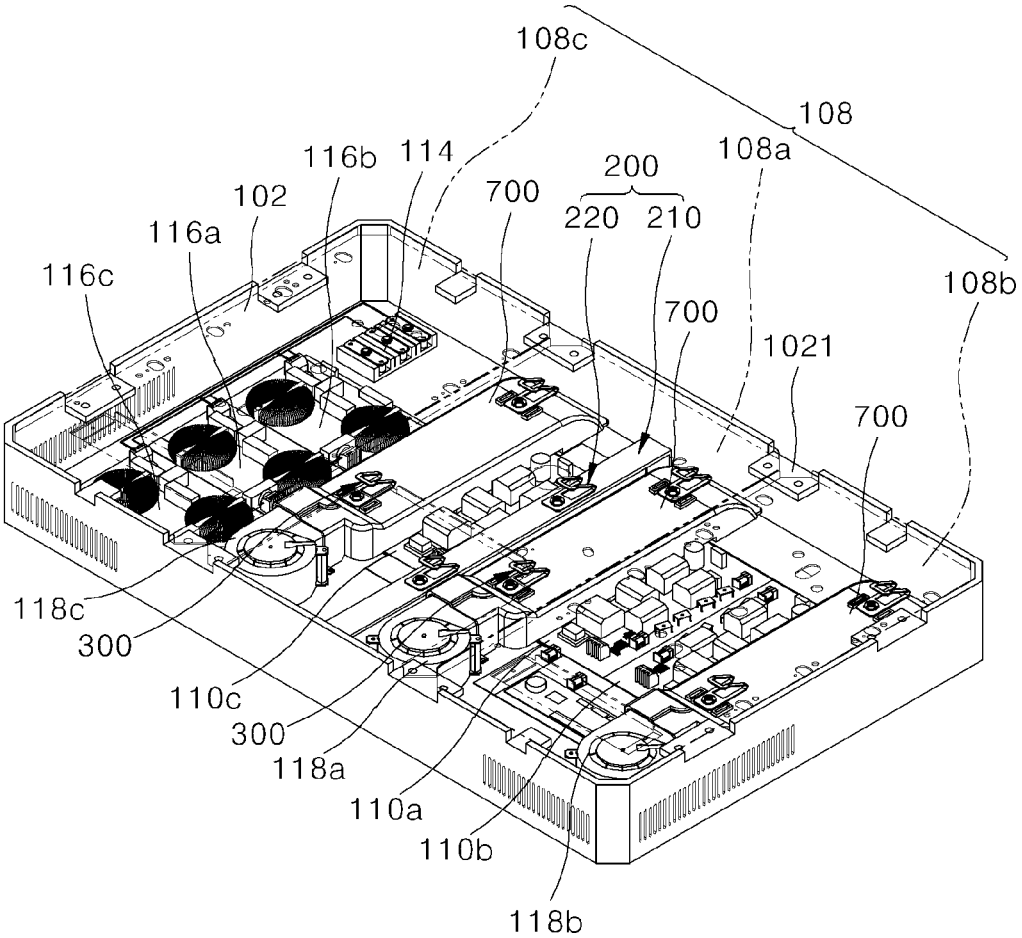
FIG. 6 is a perspective view of an electric range having supporters according to an embodiment.

FIG. 6 is a perspective view of an electric range according to an embodiment.

Referring to FIG. 6, the electric range 100 according to an embodiment may include case 102, one or more base plate 108*a*, 108*b*, 108*c* (see FIG. 3), one or more working coil 106*a*, 106*b*, 106*c*, 106*d*, 106*e*, and elastic supporter 300, as described above. The case 102 may be a plate member having a rectangular shape an upper portion of which is open. That is, the case 102 may include four walls and a bottom surface.

Referring to FIG. 3, the one or more base plate 108*a*, 108*b*, 108*c* may include first, second, and third base plates 108*a*, 108*b*, 108*c*. The one or more working coil 106*a*, 106*b*, 106*c*, 106*d*, 106*e* may include first, second, third, fourth, and fifth working coils 106*a*, 106*b*, 106*c*, 106*d*, 106*e*.

The first working coil 106*a* may be disposed at an upper end of the first base plate 108*a*. The second and third working coils 106*b*, 106*c* may be spaced a predetermined distance apart at an upper end of the second base plate 108*b*. The fourth and fifth working coils 106*d*, 106*e* may be spaced a predetermined distance apart at an upper end of the third base plate 108*c*.

The first, second, and third base plates 108*a*, 108*b*, 108*c* may be disposed such that the first, second, and third base plates 108*a*, 108*b*, 108*c* are adjacent to each other. The first, second, and third base plates 108*a*, 108*b*, 108*c* may be disposed at an upper end of the case 102.

The above-described drive circuits 110*a*, 110*b*, 110*c* may be disposed in the case 102. The drive circuits 110*a*, 110*b*, 110*c* may be a printed circuit board (PCB). The drive circuits 110*a*, 110*b*, 110*c* may be provided with a plurality of electronic components. When the electronic components are driven, the drive circuits 110*a*, 110*b*, 110*c* may generate a certain amount of heat.

The above-described air blowing fans 118*a*, 118*b*, 118*c* may be disposed near the drive circuits 110*a*, 110*b*, 110*c*. The air blowing fans 118*a*, 118*b*, 118*c* may supply a predetermined-temperature air for cooling to the drive circuits 110*a*, 110*b*, 110*c* from the outside, to allow the drive circuits 110*a*, 110*b*, 110*c* to dissipate heat.

The case 102 may be provided with one or more air guide 700. A number of the air guides 700 may correspond to a number of the drive circuits 110*a*, 110*b*, 110*c*. The air guides 700 may guide airflow, generated by the air blowing fans 118*a*, 118*b*, 118*c*, to the drive circuits 110*a*, 110*b*, 110*c*.

The air guides 700 may be configured to cover the drive circuits 110*a*, 110*b*, 110*c*. An inlet 720 (see FIG. 7) formed at one (first) end of the air guide 700 may be open. The inlet 720 may connect to an outlet of the air blowing fan 118*a*, 118*b*, 118*c* through which air may be discharged. The outlet of the air blowing fan 118*a*, 118*b*, 118*c* may be inserted into the inlet 720 of the air guide 700, to connect to the inlet 720 of the air guide 700.

Accordingly, air supplied through the outlet of the air blowing fan 118*a*, 118*b*, 118*c* may be readily guided to an entire area of the drive circuit 110*a*, 110*b*, 110*c* through the air guide 700. The air guide 700 may prevent loss of air, discharged through the air blowing fan 118*a*, 118*b*, 118*c*, to an outside area of the drive circuit 110*a*, 110*b*, 110*c*.

A configuration of the air guide 700 is described hereinafter.

Figure 7:
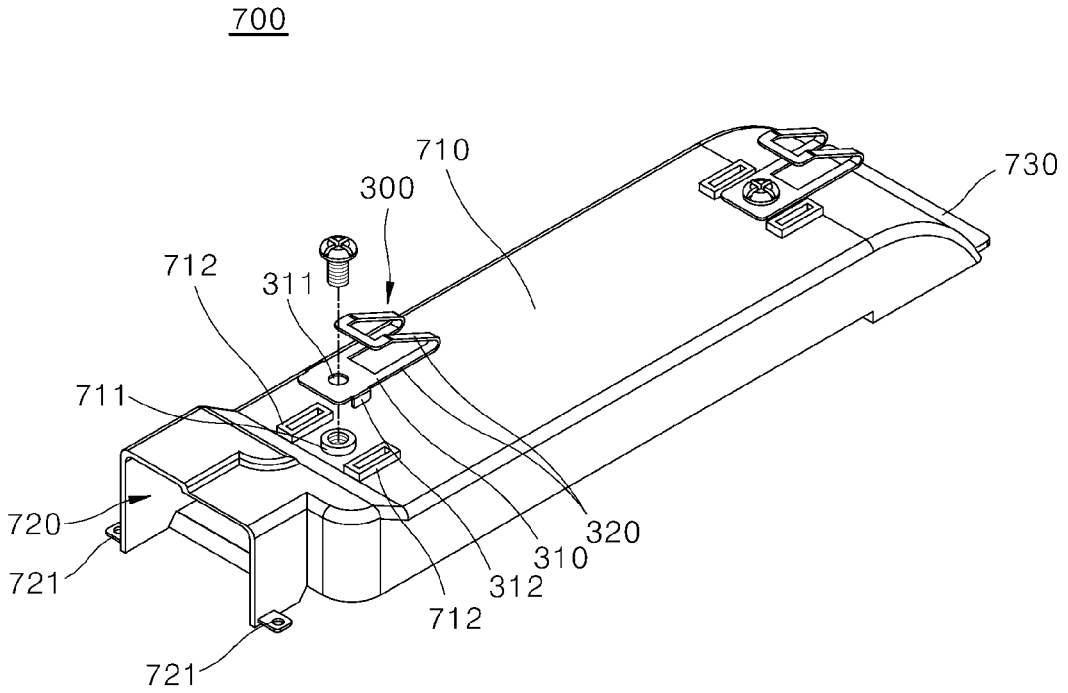
FIG. 7 is a perspective view of an air guide according to an embodiment.
Figure 8:
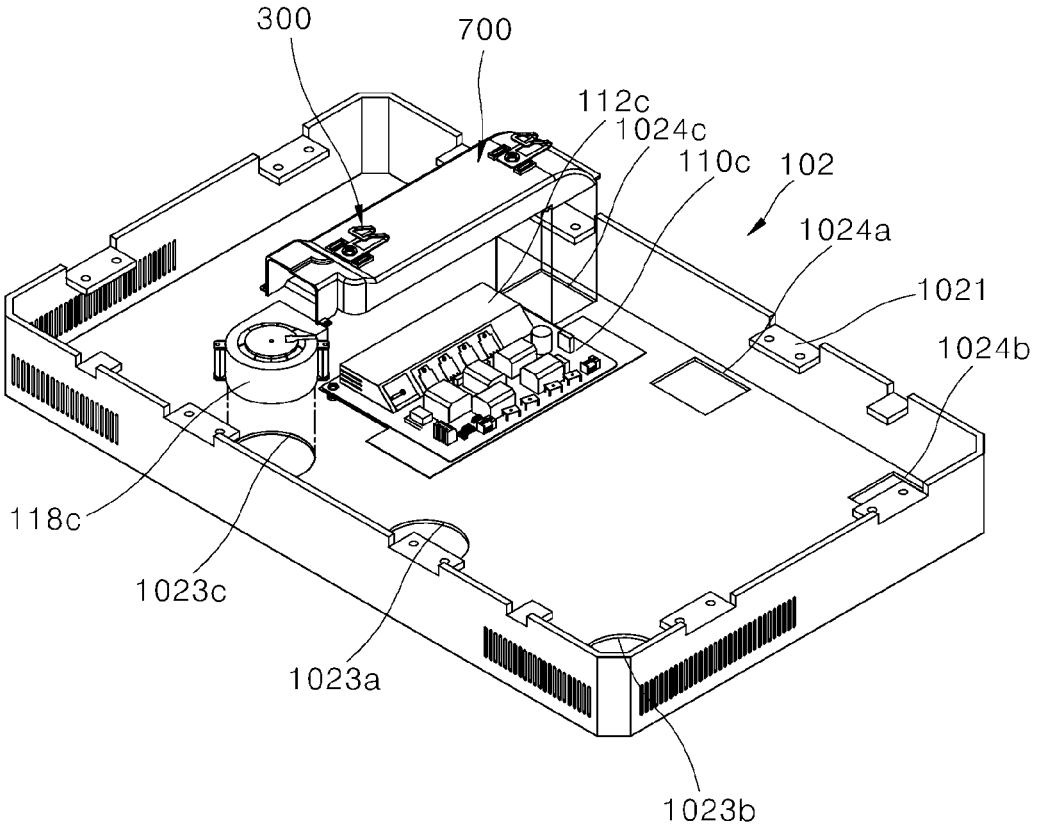
FIG. 8 is a perspective view showing a state in which an air guide according to an embodiment is installed.

FIG. 7 is a perspective view of an air guide according to an embodiment. FIG. 8 is a perspective view showing a state in which an air guide according to an embodiment is installed. Hereinafter, reference numeral "700" refers to the air guide, "110" to the drive circuit, "106" to the base plate, and "108" to the air blowing fan.

The air guide 700, as described above, may be disposed in the case 102 to cover each of the drive circuits 110. Referring to FIG. 7, the air guide 700 may include a housing 710. The housing 710 may have a "⊓"-shaped cross section (open U-shape or channel type) in a lengthwise direction. The housing 710 may have an inner surface corresponding to the above shape. The housing 710 may have a predetermined length. The length of the housing 710 may be greater than a length of the drive circuit 110 by a predetermined length. Additionally, a width of the housing 710 may be greater than a width of the drive circuit 110 by a predetermined width. The housing 710 may have a lower portion which is open. Accordingly, the housing 710 may have a structure in which the housing 710 covers the drive circuit 110.

The housing 710 may include inlet 720 at one (first) end thereof, and the inlet 720 may be open. A coupling hole 721 may be respectively formed at lower ends of both walls of the inlet 720. Referring to FIG. 8, the coupling hole 721 may be coupled to another coupling hole (not illustrated) on a bottom surface of the case 102 through a coupling member (not illustrated). The other (second) end side of the housing 710 may be formed into a bent shape having a predetermined curvature along a downward direction.

The housing 710 may have a jaw 730 at an end of the other end thereof. The jaw 730 may be held in any one of a 2-1th through hole 1024*a*, or a 2-2th through hole 1024*b* and a 2-3th through hole 1024*c* formed on the bottom surface of the case 102.

Accordingly, the housing 710 may be installed on the bottom surface of the case 102 in the state in which the housing 710 covers an upper portion of the above-described drive circuit 110. An inner surface of the housing 710 may be spaced a predetermined distance apart from the upper portion of the drive circuit 110.

The inlet 720 formed at the one end of the housing 710 may connect to the outlet of the air blowing fan 118. A flow of air discharged from the outlet of the air blowing fan 118 may be guided such that the air is supplied to the drive circuit 110 along the inner surface of the housing 710. The drive circuit 110 may dissipate heat using the supplied air.

The air guide 700 according to an embodiment may be made of heat-resistant plastics, for example. The air guide 700 may also be made of aluminum, for example. Additionally, the air guide 700 may be further provided with heat dissipation pins (not illustrated) on an outside of the air guide 700.

Figure 9:
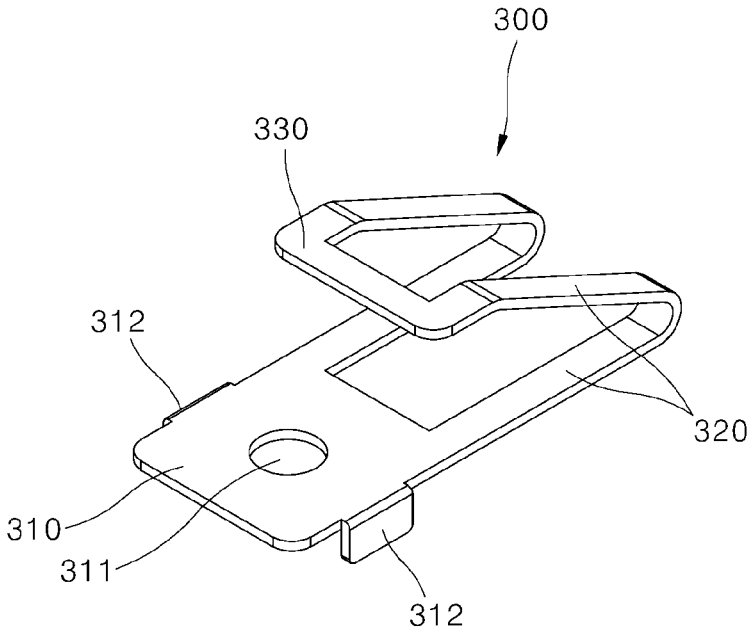
FIG. 9 is a perspective view of an elastic member according to an embodiment.

FIG. 9 is a perspective view of an elastic supporter according to an embodiment. Referring to FIG. 9, elastic supporter 300 according to an embodiment may be disposed at a plurality of positions at an upper end of the air guide 700. The elastic supporter 300 may be a leaf spring, for example. The elastic supporter 300 may be an elastic member that can return to its original shape using elasticity, in addition to the leaf spring.

A plurality of elastic supporters 300 may be disposed at a plurality of positions at the upper end of the housing 710. Lower ends of the plurality of elastic members 300 may be fixed to the upper end of the housing 710. Upper ends of the plurality of elastic members 300 may elastically support a plurality of positions of a lower surface of the base plate 108.

Each of the plurality of elastic members 300 may have the same configuration. Each of the elastic members 300 may be formed into a V-shaped leaf spring. The elastic member 300 may include a fixed piece 310, an elastic piece 320, and a support piece 330.

The fixed piece 310 may be fixed to a predetermined position of the upper end of the housing 710. The fixed piece 310 may have a first fixing hole 311. A pair of position determination projections 312 bent along the downward direction may be formed at both side portions (sides) of the fixed piece 310. The position determination projections 312 may each be a rectangular piece, for example.

The housing 710 may have a second fixing hole 711 at a predetermined position thereof. A pair of position determination holes 712 may be formed at both side portions of the second fixing hole 711. The position determination holes 712 may each be a rectangular hole, for example. A fixing member (not illustrated) may be coupled to the first fixing hole 311 and the second fixing hole 711. Accordingly, the fixed piece 310 may be fixed to the upper end of the housing 710. The pair of position determination projections 312 may be fitted into the pair of position determination holes 712.

The support piece 330 may be disposed over the fixed piece 310. The fixed piece 310 may support the lower surface of the base plate 108 disposed on the housing 710.

The elastic piece 320 may have a predetermined level of elasticity. The elastic piece 320 may elastically connect the fixed piece 310 and the support piece 330. A lower end of the elastic piece 320 may connect to one end of the fixed piece 310, and the other end may connect to one end of the support piece 330. The elastic piece 320 may have a V shape that spreads apart in one direction/toward one side.

The elastic piece 320 may be formed into a body that is branched into two at one end of the fixed piece 310. The support piece 330 may connect to an upper end of the elastic piece 320 branched into two, in a plate form.

A lower surface of each of the base plates 108 may be supported by the support piece 330. The fixed piece 310 may be fixed to the upper end of the housing 710. The elastic piece 320 may elastically support the lower surface of each of the base plates 108, between the fixed piece 310 and the support piece 330.

Figure 10:
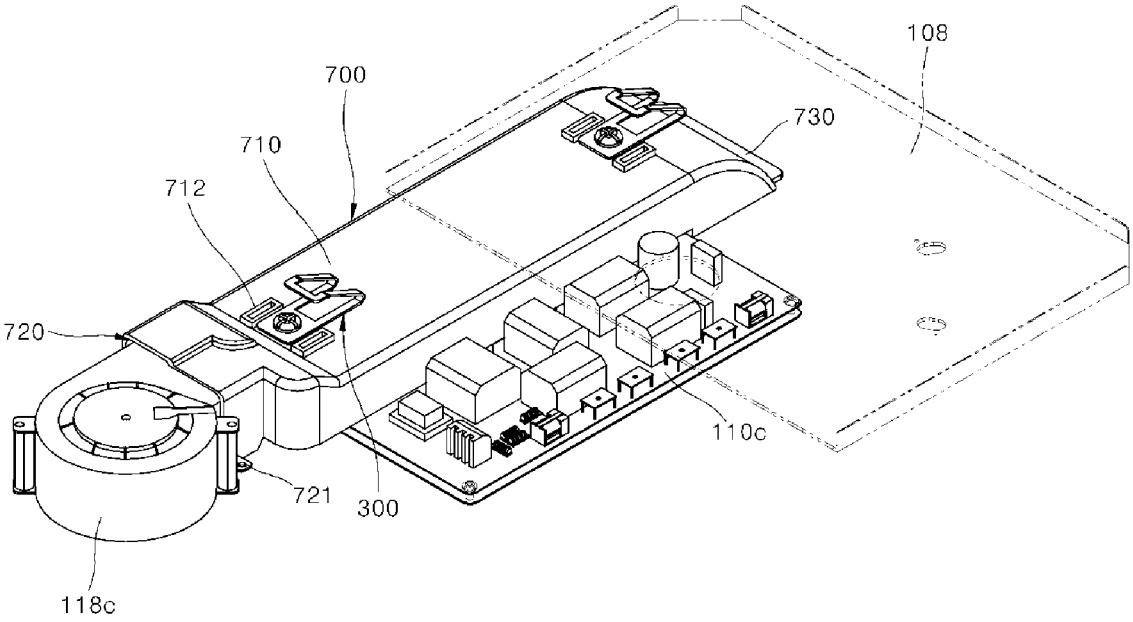
FIG. 10 is a perspective view showing a state in which a base plate is supported by an elastic supporter on an air guide according to an embodiment.
Figure 11:
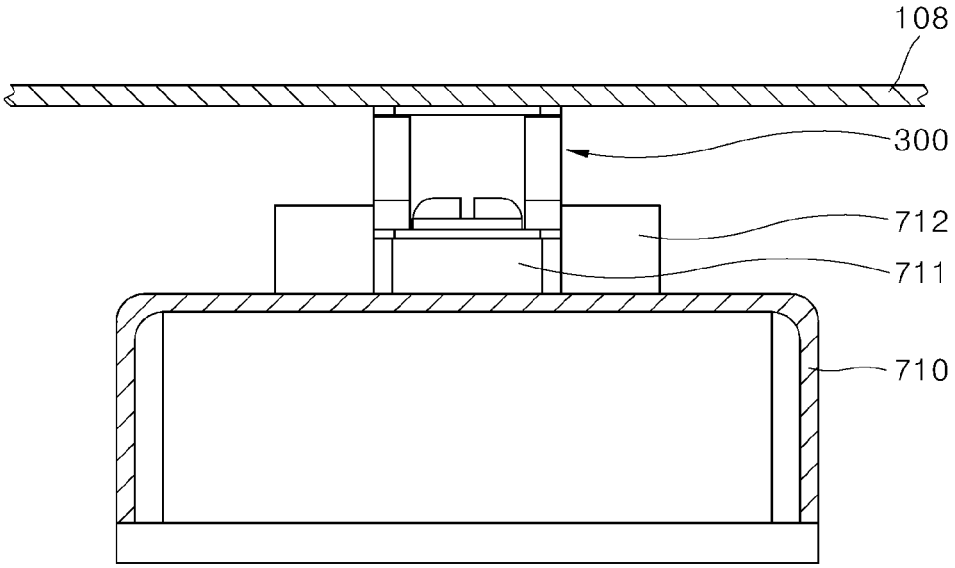
FIG. 11 is a cross-section view, taken along line XI-XI in FIG. 10 and a cross-sectional view showing a coupling of an air guide, an elastic supporter, and a base plate according to an embodiment.

FIG. 10 is a perspective view showing a state in which a base plate is supported by an elastic supporter on an air guide according to an embodiment. FIG. 11 is a cross-section view, taken along line XI-XI in FIG. 10 and a cross-sectional view showing a coupling of configurations of an air guide, an elastic supporter, and a base plate according to an embodiment.

A mechanism for preventing sagging of the base plate 108 according to an embodiment is described with reference to FIGS. 10 and 11.

A plurality of elastic supporters 300 may be disposed at the upper end of the air guide 700 having the above configuration. When a plurality of air guides 700 described above is provided, a plurality of elastic supporters 300 may be respectively disposed at the upper end of each of the air guides 700.

Referring to FIGS. 10 and 11, the elastic supporters 300 formed into a leaf spring may be disposed at a plurality of positions of the upper end of the housing 710 of the air guide 700. The upper end of the elastic supporter 300 is not fixed.

The base plate 108 may be disposed on the air guide 700. The working coils 106*a*, 106*b*, 106*c*, 106*d*, 106*e* (see FIG. 2) having a predetermined weight may be disposed at the upper end of the base plate 108. The base plate 108 may be made of aluminum having a predetermined thickness, for example. Accordingly, a self-weight of the working coils 106*a*, 106*b*, 106*c*, 106*d*, 106*e* may be applied downward depending on the weight of the working coils 106*a*, 106*b*, 106*c*, 106*d*, 106*e*. As a result, the base plate 108 may bend downward at a position where the working coils 106*a*, 106*b*, 106*c*, 106*d*, 106*e* is disposed.

The plurality of elastic supporters 300 according to an embodiment may elastically support the lower surface of the base plate 108. For example, the plurality of elastic supporters 300 may be disposed in an area where the working coils 106*a*, 106*b*, 106*c*, 106*d*, 106*e* are disposed.

The plurality of elastic supporters 300 may elastically support the lower surface of the base plate 108 at a position corresponding to the area where the working coils 106*a*, 106*b*, 106*c*, 106*d*, 106*e* are disposed, at the upper end of the air guide 700. Thus, the plurality of elastic supporters 300 according to an embodiment may prevent deformation, such as downward sagging or downward bending of the base plate 108, and may reduce heat generated by the working coils 106*a*, 106*b*, 106*c*, 106*d*, 106*e* as a result of reduction in resonance current by maintaining a constant gap between the working coils 106*a*, 106*b*, 106*c*, 106*d*, 106*e* and an object to be heated over the working coils 106*a*, 106*b*, 106*c*, 106*d*, 106*e*.

The air guide 700 according to an embodiment may be disposed under each of the base plates 108, as illustrated in FIG. 6. A plurality of elastic supporters 300 may be disposed at the upper end of each of the air guides 700. Accordingly, the lower surface of each of the base plates 108 may be elastically supported by the elastic supporters 300 disposed at the upper end of each of the air guides 700. That is, each base plate 108 may be prevented from sagging downward as a result of support from each elastic supporter 300.

Referring to FIGS. 2, 3 and 6, a central portion of the first base plate 108*a* on which the first working coil 106*a* is disposed may sag further than any other area due to the weight of the first working coil 106*a*. To solve this problem, the elastic supporters 300 at the upper end of the air guide 700 according to an embodiment may be disposed to support the central portion of the lower surface of the first base plate 108*a*. Alternatively, the elastic supporters 300 at the upper end of the air guide 700 may be disposed to support a portion under a central portion of the first working coil 106*a* while supporting a portion under the area in which the first working coil 106*a* is installed.

Additionally, as the dual-type first working coil 106*a* weighs more than any other working coil (the second, third, fourth and fifth working coils 106*b*, 106*c*, 106*d*, 106*e*), the elastic supporters 300 at the upper end of the air guide 700 may support the lower surface of the first base plate 108*a* at a lower side the first working coil 106*a*.

The structure in which the elastic supporter 300 is disposed at the upper end of each air guide 700 and supports the lower surface of each base plate 108 is described above.

Referring to FIG. 6, supporter 200 may be further formed on a bottom surface of an inner space of the case 102 according to an embodiment. The supporter 200 may include a bracket 210 having a linear shape, for example.

Both ends of the bracket 210 may be bent at a right angle. The bent portion may be fixed onto the bottom surface of the case 102. The bracket 210 may have a predetermined length and may be spaced from apart a lower portion of the base plate 108.

Other elastic members 220 having the same shape as the elastic supporter 300 described above may be disposed at a plurality of positions of an upper end of the bracket 210. Accordingly, other elastic supporters 220 may additionally provide an elastic support to the lower surface of the base plate 108 elastically in a state of being fixed to a plurality of positions of the upper end of the bracket 210.

Thus, the lower surface of the base plate 108 may be supplementarily supported as a result of the bracket 210 having elastic supporters 220 described above, according to an embodiment. With this configuration, the base plate 108 may be prevented from sagging downward. Additionally, when the return elasticity of any one or all of the elastic supporters 220 is reduced, other elastic supporters 220 described above may supplement the elastic supporters 300 to stably support the base plate 108.

Further, other elastic supporters 220 described above may be disposed at a predetermined position of the upper end of the bracket 210 to be placed in a lower area where the working coil 106*a*, 106*b*, 106*c*, 106*d*, 106*e* is disposed. When the working coil 106*a*, 106*b*, 106*c*, 106*d*, 106*e* is disposed at the central portion of the base plate 108, other elastic supporters 220 described above may be disposed at a center of the upper end of the bracket 210, for example.

Figure 12:
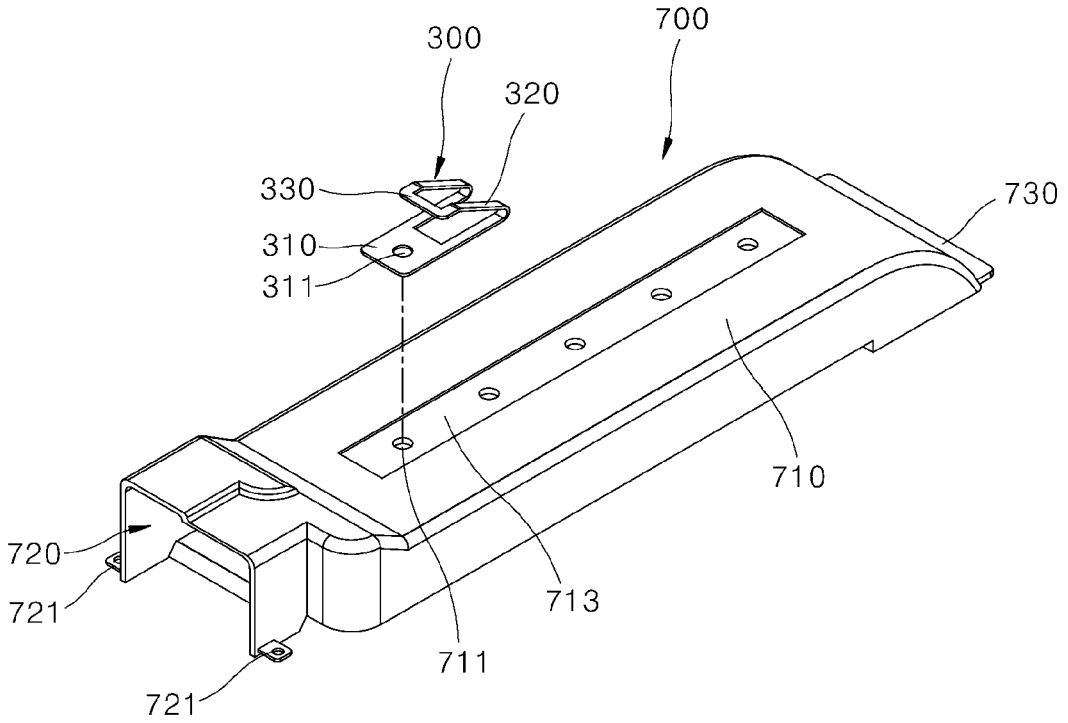
FIG. 12 is a view showing an example in which positions of elastic supporters according to an embodiment may be changed at an upper end of an air guide.

FIG. 12 is a view showing an example in which positions of elastic supporters according to an embodiment may be changed at an upper end of an air guide. Referring to FIG. 12, a guide groove 713 that guides a position of movement of the plurality of elastic supporters 300 may be further formed at the upper end of the air guide 700 according to an embodiment. Accordingly, the plurality of elastic supporters 300 may be moved to predetermine positions, and a position of the lower surface of the base plate 108 elastically supported by the plurality of elastic supporters 300 may change. Position change holes 711 may be spaced a predetermined distance apart in the guide groove 713.

Each elastic supporter 300 may be fixed at a position to which the elastic supporter 300 moves, through position change hole 711 at a position to which the fixing hole 311 of the elastic supporter 300 moves and through a fixing screw (not illustrated). Accordingly, the elastic supporters 300 may be fixed to the positions to which the elastic supporters move.

Further, positions supported by the plurality of elastic supporters 300 may be included in a surface area of the working coil 106*a*, 106*b*, 106*c*, 106*d*, 106*e* disposed at the upper end of the base plate 108, for example. That is, the plurality of elastic supporters 300 may be disposed below the working coils 106*a*, 106*b*, 106*c*, 106*d*, 106*e*.

As described with reference to the above examples, according to an embodiment, the plurality of elastic supporters 300 at the upper end of the air guide 700 may be spaced at regular intervals and may support the lower portions of the base plates 108 on which the working coils 106*a*, 106*b*, 106*c*, 106*d*, 106*e* are disposed, thereby preventing the base plates 108 from sagging. Further, according to an embodiment, as a gap between an object to be heated and the working coils 106*a*, 106*b*, 106*c*, 106*d*, 106*e* may be maintained, uniformity in heating the object to be heated may be ensured and heat generation of the working coils 106*a*, 106*b*, 106*c*, 106*d*, 106*e* may be prevented. Furthermore, according to an embodiment, the lower portion of the base plate 108 on which the working coils 106*a*, 106*b*, 106*c*, 106*d*, 106*e* are disposed may be elastically supported, thereby absorbing an external impact applied to the base plate 108.

Figure 13:
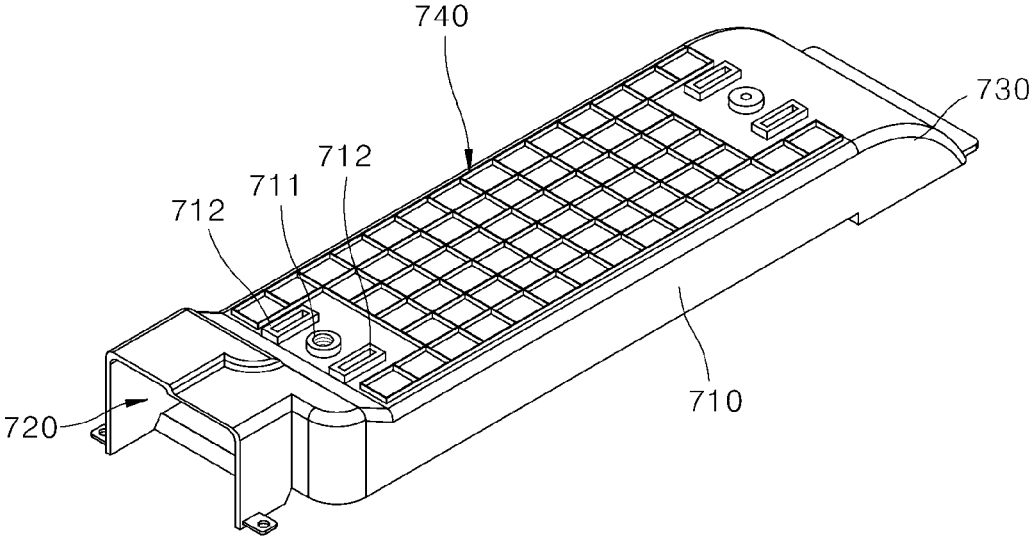
FIG. 13 is a view showing an example in which a reinforcing member is further formed in an air guide according to an embodiment.

FIG. 13 is a view showing an example in which a reinforcing member is further formed on an air guide according to an embodiment. Referring to FIG. 13, the air guide 700 according to an embodiment may include a reinforcing member (frame) 740.

The reinforcing member 740 may protrude from the upper end of the housing 710 of the air guide 700. The reinforcing member 740 maybe formed into a protruding grid shape, for example. The reinforcing member 740 may protrude from a side of the air guide 700.

Certainly, another reinforcing member (not illustrated) with an injection-molded metallic frame may be buried into the air guide 700. The reinforcing member 740 may prevent sagging of the upper end of the air guide 700.

That is, elastic supporters 300 may be disposed at a plurality of positions of the upper end of the air guide 700. The elastic supporters 300 may support the lower surface of the base plate 108 that allows the working coil 106*a*, 106*b*, 106*c*, 106*d*, 106*e* to be placed at the upper end thereof.

Accordingly, a predetermined self-weight may be applied to the elastic supporters 300 along the downward direction. The self-weight may be applied to the housing 710 where the elastic supporter 300 is disposed. When the housing 710 is made of plastics and has a predetermined small thickness, a portion of the upper end of the housing 710 where the elastic supporters 300 are disposed may sag downward. To solve this problem, the reinforcing member 740 according to an embodiment may help to increase rigidity of the upper end of the housing 710 and readily prevent the downward sagging of the upper end of the housing 710, caused by the self-weight.

Though not illustrated in the drawings, support rods may be further formed along upward and downward directions on an inner surface of the upper end of the housing 710. Lower ends of the support rods may be disposed in the outside area of the drive circuit 110 and supported by the bottom surface of the case 102, for example.

Alternatively, holes through which the support rods pass may be formed at the drive circuit 110. The lower ends of the support rods passing through the drive circuit 110 may be supported by the bottom surface of the case 102. As upper ends of the support rods connect to the inner surface of the upper end of the housing and the lower ends are supported by the bottom surface of the case 102, the upper end of the housing may be prevented from sagging downward.

As a result, the upper end of the housing 710 of the air guide 700 may be prevented from being deformed through the elastic supporters 300 supporting the lower surface of the base plate 108, thereby supporting the base plate 108 more stably, according to the present disclosure.

Embodiments disclosed herein are directed to an electric range in which elastic members that elastically supports a lower surface of a base plate are disposed at an upper end of an air guide disposed below the base plate, thereby preventing sagging of the base plate that allows a working coil to be disposed at an upper end thereof. Embodiments disclosed herein are also directed to an electric range in which the lower surface of the base plate is supported by the elastic members disposed at the upper end of the air guide, thereby maintaining a constant gap between an object to be heated and the working coil.

Advantages are not limited to the above ones, and other advantages that are not mentioned above may be clearly understood from the description and may be more clearly understood from the embodiments set forth herein. Additionally, aspects and advantages may can be realized via means and combinations thereof that are described in the appended claims.

In the electric range according to embodiments disclosed herein, a lower end of the base plate, which allows a working coil to be placed at the upper end thereof, may be supported by the elastic supporters disposed at the upper end of the air guide along a widthwise direction of the base plate, thereby preventing bending of the base plate and maintaining a constant gap between an object to be heated and the working coil. The elastic members elastically supporting the lower surface of the base plate may be disposed at the upper end of the air guide disposed below/under the base plate, thereby preventing sagging of the base plate that allows a working coil to be placed at the upper end thereof. The lower surface of the base plate may supported by the elastic members disposed at the upper end of the air guide, thereby maintaining a constant gap between an object to be heated and the working coil.

The embodiments are described above with reference to a number of illustrative embodiments thereof. However, the embodiments are not intended to be limited the embodiments and drawings set forth herein, and numerous other modifications and embodiments can be devised by one skilled in the art without departing from the technical spirit. Further, the effects and predictable effects based on the configurations in the disclosure are to be included within the range though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric range, comprising:

a case, an upper portion of which is open and having an inner space in which at least one drive circuit and at least one air blowing fan are disposed;

at least one base plate disposed at the upper portion of the case;

at least one working coil disposed on the at least one base plate; and at least one air guide disposed below the at least one base plate within the case, configured to cover the at least one drive circuit, and having an inlet disposed at a front end of the at least one air blowing fan; and a plurality of elastic supporters fixed at a plurality of positions to an upper surface of the at least one air guide, and configured to support a lower surface of the at least one base plate, wherein a fixing portion that fixes the plurality of elastic supporters is respectively disposed at the plurality of positions at the upper surface of the at least one air guide, wherein each fixing portion comprises a pair of support projections that is spaced a predetermined distance apart at the upper surface of the at least one air guide and protrudes upward, and a fixing projection having a first fixing hole that protrudes from the upper surface of the at least one air guide such that the fixing projection is disposed between the pair of the support projections, wherein a lower end of the elastic supporter is mounted onto upper ends of the pair of support projections and the fixing projection, and wherein a second fixing hole formed at the lower end of the elastic supporter is mounted such that a position of the second fixing hole is aligned with a position of the first fixing hole.

2. The electric range of claim 1, wherein the at least one air guide has a predetermined length along a widthwise direction of the at least one base plate, and wherein the plurality of elastic supporters is spaced a predetermined distance apart along the widthwise direction.

3. The electric range of claim 2, wherein each of the plurality of elastic supporters is a leaf spring.

4. The electric range of claim 2, wherein each of the plurality of elastic supporters comprises a first fixed piece having a plate shape and fixed to the upper surface of the at least one air guide, a second fixed piece having a plate shape and configured to support the lower surface of the at least one base plate, and an elastic piece formed to spread apart and configured to connect one end of the first fixed piece and one end of the second fixed piece.

5. The electric range of claim 2, wherein a reinforcing frame having a grid shape is formed at the upper surface of the at least one air guide.

6. The electric range of claim 1, wherein the at least one base plate comprises a plurality of base plates disposed at an upper end of the case such that the plurality of base plates is adjacent to each other, and wherein the plurality of elastic supporters is provided to support a lower end of each of the plurality of base plates.

7. The electric range of claim 1, further comprising a supporter disposed on a bottom surface of the case, wherein the supporter includes a bracket both ends of which are supported by the bottom surface of the case, and a plurality of elastic supporters disposed at a plurality of positions at an upper end of the bracket to elastically support the lower surface of the at least one base plate.

8. The electric range of claim 1, wherein the at least one working coil is disposed in a central portion of the at least one base plate, and wherein the plurality of elastic supporters supports the lower surface at the central portion of the at least one base plate.

9. The electric range of claim 8, wherein the plurality of elastic supporters supports an area below a central portion of the at least one working coil at the lower surface of the at least one base plate.

10. The electric range of claim 1, wherein the at least one working coil comprises a plurality of working coils, and wherein the plurality of elastic supporters is disposed to support a lower surface of the at least one base plate on which a heaviest working coil among the plurality of working coils is disposed.

11. The electric range of claim 1, wherein the plurality of elastic supporters is configured to support an area under the at least one base plate, on which the at least one working coil is disposed.

12. The electric range of claim 1, wherein the at least one base plate comprises a plurality of base plates disposed adjacent to one another, and wherein the plurality of elastic supporters is configured to support a lower portion of a base plate disposed at a center of the plurality of base plates.

13. An electric range, comprising:

a case, an upper portion of which is open and having an inner space in which at least one drive circuit and at least one air blowing fan are disposed;

at least one base plate disposed at the upper portion of the case;

at least one working coil disposed on the at least one base plate; and at least one air guide disposed below the at least one base plate within the case, configured to cover the at least one drive circuit, and having an inlet disposed at a front end of the at least one air blowing fan;

at least one elastic supporter fixed to an upper surface of the at least one air guide, and configured to support a lower surface of the at least one base plate, wherein the at least one air guide has a predetermined length along a widthwise direction of the at least one base plate, and the at least one elastic supporter comprises a plurality of elastic supporters, spaced a predetermined distance apart along the widthwise direction, and disposed at a plurality of positions at the upper surface of the at least one air guide; and a supporter disposed on a bottom surface of the case, wherein the supporter includes a bracket both ends of which are supported by the bottom surface of the case, wherein the at least one elastic supporter further comprises a plurality of elastic supporters disposed at a plurality of positions at an upper end of the bracket to elastically support the lower surface of the at least one base plate, wherein the supporter is disposed adjacent to the at least one air guide, wherein a fixing portion that fixes the plurality of elastic supporters is respectively disposed at the plurality of positions at the upper surface of the at least one air guide, wherein each fixing portion comprises a pair of support projections that is spaced a predetermined distance apart at the upper surface of the at least one air guide and protrudes upward, and a fixing projection having a first fixing hole that protrudes from the upper surface of the at least one air guide such that the fixing projection is disposed between the pair of the support projections, wherein a lower end of the elastic supporter is mounted onto upper ends of the pair of support projections and the fixing projection, and wherein a second fixing hole formed at the lower end of the elastic supporter is mounted such that a position of the second fixing hole is aligned with a position of the first fixing hole.

14. The electric range of claim 13, wherein each of the plurality of elastic supporters is a leaf spring.

15. The electric range of claim 13, wherein each of the plurality of elastic supporters comprises a first fixed piece having a plate shape and fixed to the upper surface of the at least one air guide, a second fixed piece having a plate shape and configured to support the lower surface of the at least one base plate, and an elastic piece formed to spread apart and configured to connect one end of the first fixed piece and one end of the second fixed piece.

16. The electric range of claim 13, wherein the at least one working coil is disposed in a central portion of the at least one base plate, and wherein at least one elastic supporter of the plurality of elastic supporters supports the lower surface at the central portion of the at least one base plate.

17. The electric range of claim 13, wherein at least one elastic supporter of the plurality of elastic supporters supports an area below a central portion of the at least one working coil at the lower surface of the at least one base plate.

* * * * *